US005285722A

United States Patent [19]

Schockman

[11] Patent Number: 5,285,722

[45] Date of Patent: Feb. 15, 1994

[54] PRESS SHUTHEIGHT ADJUSTMENT USING HYDRAULIC TIE ROD ASSEMBLIES

[75] Inventor: Robert L. Schockman, St. Henry, Ohio

[73] Assignee: The Minster Machine Company, Minster, Ohio

[21] Appl. No.: 977,141

[22] Filed: Nov. 16, 1992

[51] Int. Cl.[5] ..... B30B 15/14

[52] U.S. Cl. ..... 100/53; 72/21; 72/446; 100/99; 100/214; 100/257

[58] Field of Search ..... 100/53, 99, 214, 257; 72/21, 446, 448, 455; 83/527, 530

[56] References Cited

U.S. PATENT DOCUMENTS

| | | | |
|---|---|---|---|
| 2,517,265 | 10/1951 | Leufven . | |
| 2,616,543 | 11/1952 | Danly | 192/150 |
| 2,934,968 | 5/1960 | Neumann . | |
| 3,154,006 | 10/1964 | Novak | 100/35 |
| 3,160,089 | 12/1964 | Platou | 100/214 |
| 3,400,625 | 9/1968 | Wrona | 100/257 X |
| 3,424,080 | 1/1969 | Pappas | 100/214 |
| 3,462,180 | 8/1969 | Bunyan . | |
| 3,858,432 | 1/1975 | Voorhees et al. | 72/455 |
| 4,085,649 | 4/1978 | Christensson . | |
| 4,166,415 | 9/1979 | Spanke et al. | 100/53 |
| 4,307,599 | 12/1981 | Wrona | 72/446 |
| 4,502,379 | 3/1985 | Sato | 100/214 |
| 4,533,313 | 8/1985 | Poncet | 425/451.2 |
| 4,802,806 | 2/1989 | Sevelinge | 411/383 |
| 4,854,798 | 8/1989 | Snyder et al. | 411/434 |
| 4,884,934 | 12/1989 | Ikeda et al. | 411/383 |
| 4,939,918 | 7/1990 | Schoch | 72/20 |

FOREIGN PATENT DOCUMENTS

| | | | |
|---|---|---|---|
| 2455788 | 8/1976 | Fed. Rep. of Germany | 411/434 |
| 2-274399 | 11/1990 | Japan | 100/214 |

*Primary Examiner*—Stephen F. Gerrity
*Attorney, Agent, or Firm*—Baker & Daniels

[57] ABSTRACT

A shutheight adjustment system incorporating hydraulic tie rod nut assemblies for dynamically altering the tensioning and compression of the tie rods of a power press. Each hydraulic tie rod nut assembly includes a cylinder with an inner sliding piston threadably engaging the tie rod. A pressurizing mechanism injects pressurized fluid within a chamber formed by the piston and cylinder. By increasing pressure within the chamber of the hydraulic tie rod nut assembly, compression between the press bed and press crown may be increased thereby reducing the press shutheight.

16 Claims, 3 Drawing Sheets

PRESS SHUTHEIGHT ADJUSTMENT USING HYDRAULIC TIE ROD ASSEMBLIES

BACKGROUND OF THE INVENTION

The present invention relates generally to mechanical presses and in particular to a shutheight adjustment mechanism utilizing a hydraulic tie rod assembly to change press shutheight while the press is operating.

Mechanical presses, for example, stamping presses and drawing presses, comprise a frame having a crown and bed with a slide supported within the frame for motion toward and away from the bed. The slide is driven by a crankshaft having a connecting arm connected to the slide. Such mechanical presses are widely used for stamping and drawing operations and vary substantially in size and available tonnage depending upon the intended use.

In prior art presses of this type, the slide is generally connected to the crankshaft by a connection mechanism rod which is adjustable in length. The connecting rod is attached to another member that is adjustable in its relation to the slide so that the shutheight opening between the slide and the bed can be adjusted to accommodate various die sets. A normal slide adjustment mechanism adjusts the slide to a predetermined operating shutheight. Alternatively, the bed portion or bolster of the press may have its position adjusted relative to the slide so as to adjust the shutheight therebetween, as disclosed in U.S. Pat. No. 3,858,432. Regardless of the mode of shutheight adjustment, the slide is generally guided on the uprights of the press frame extending between the crown and the bed so that the parts of the die set remain in precise registration as the slide reciprocates.

A prior art patent, U.S. Pat. No. 4,502,379, shows a press in which shutheight is controlled by adjustment members located between the press crown and bed. Expansion and contraction of the adjustment members was accomplished by supplying hydraulic fluid into the members and thereby changing shutheight. This prior press has a disadvantage, in that by including the adjustment member within the press uprights, the cross section of the press uprights necessarily becomes larger. Another operational problem exists that if a seal on the adjustment member fails, the entire press would have to be dismantled to replace the seal.

Another example of press shutheight control is described in U.S Pat. No. 4,939,918, in which a fluid chamber beneath the lower press die is filled with pressurized oil to cause changes in press shutheight or load. A disadvantage to this system is that it does not lend itself to simple retrofitting on existing presses.

In mechanical presses utilized in stamping staked laminations, for example, there is a need to maintain shutheight tolerances to within 0.001 to 0.002 inches. Staked laminations are normally utilized in construction of the stator or rotor cores of electric motors. These laminations need precisely stamped surfaces to allow the laminations to be press fit together. Control of press shutheight is also necessary to maintain accurate part tolerances and prolong die life. A particular problem with punch presses is that the press shutheight normally varies with changes in press speed and thermal changes in the press itself.

The present invention is directed to fill the needs and overcome the aforementioned problems associated with mechanical press shutheight adjustment mechanisms wherein it is desired to accurately control shutheight while the press is in operation by controlling the connecting force on the press tie rods.

SUMMARY OF THE INVENTION

The present invention provides an adaptable feedback shutheight system capable of automatically changing the shutheight to compensate for various press conditions.

Generally the invention provides a hydraulic tie rod nut assembly connected to a feedback system that automatically changes press shutheight to compensate for various press changes. The hydraulic tie rod nut is constructed to vary the connecting force between the press tie rod and crown in response to changes in an applied hydraulic fluid. While monitoring the press shutheight, the feedback control system changes the pressure communicated to the expandable tie rod nut assemblies thereby changing the amount of upright compression on the press and ultimately press shutheight.

An advantage of the hydraulic tie rod assembly is that by incorporating the tie rod nut assembly with the monitoring of the shutheight, a feedback system is created to automatically change the hydraulic pressure to the tie rod nut assemblies. The feedback system changes the upright compression through the press thereby changing the press shutheight.

Another advantage of the present invention is that the tie rod nut assembly with its associated feedback system can maintain the press shutheight to within 0.001 inches to 0.002 inches under changing press operating conditions. Further, press shutheight is dynamically controlled while the press is cycling.

An additional advantage of the tie rod assembly of the present invention is that the shutheight adjustment apparatus may be installed easily without any changes to the press slide drive system.

A further advantage of the shutheight hydraulic tie rod assembly system is that it is possible to retrofit existing presses with the new system for more accurate shutheight adjustment and control.

Yet another advantage of the present invention is that it is still possible to preload the press. Preloading the press structure eliminates clearances between press parts thereby making the press more dimensionally stable.

The invention, in one form thereof, comprises a press in which a crown and bed are attached together by a frame. A slide is attached to the crown for reciprocating movement in opposed relationship to the bed. A plurality of tie rods connect between the crown and the bed onto which are attached a plurality of pressure activated tie rod nut assemblies, so that when activated, the nut assemblies force the crown and the bed closer together. A feedback means is connected to a shutheight measuring means and to the tie rod nut assemblies for comparing a predetermined desired shutheight to a measured shutheight. The feedback means activates the tie rod nut assemblies when the measured shutheight deviates from the predetermined shutheight.

A pressure activated tie rod nut assembly includes a cylinder block having a cylinder bore fit about a tie rod. A piston is threadedly engaged about the tie rod and slidingly disposed within the cylinder bore thereby forming an inner chamber. A tie rod nut is threadably engaged about the tie rod, engaging the piston, so that when the inner chamber is pressurized with a liquid, the increase in pressure forces the piston and tie rod nut away from the cylinder block thereby forcing the crown and bed together.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
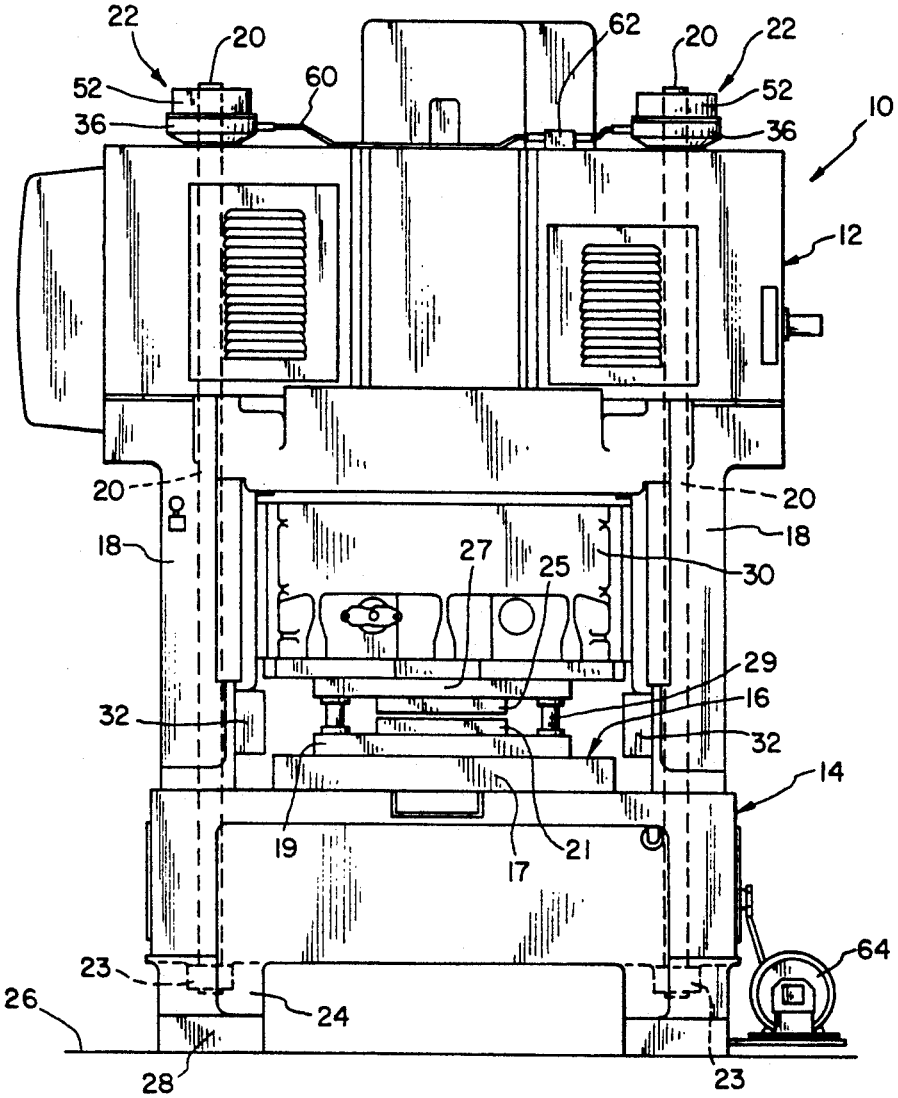
FIG. 1 is a front elevational view of a mechanical press incorporating the shutheight adjustment mechanism of the present invention.
Figure 4:
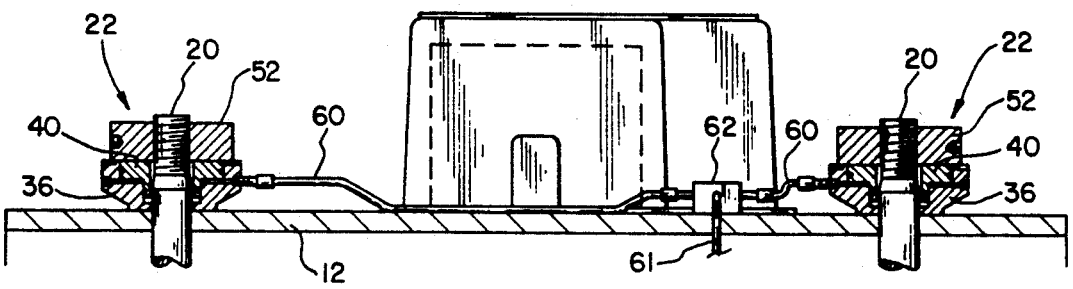
FIG. 4 is an enlarged front elevational view of the mechanical press of FIG. 1.

Referring now to FIG. 1, mechanical press 10 comprises a crown portion 12, a bed portion 14 having a bolster assembly 16 connected thereto and uprights 18 connecting crown portion 12 with bed portion 14. Bolster assembly comprises a bolster 17 having an attached lower die shoe 19 including a die 21. An opposed die 25 is attached to an upper die shoe 27 connecting with slide 30. A plurality of guide posts 29 are disposed between the upper and lower die shoes 25 and 19 in a known fashion.

Uprights 18 are connected to or integral with the underside of crown 12 and the upper side of bed 14. The slide 30 is attached to crown 12 for reciprocating movement in opposed relation to bed 14. Although press 10 is shown in a press down configuration, it could alternatively be constructed in a press up configuration by constructing the press upside down. In a press up configuration, slide 30 would be connected to the lower unit instead of the top unit, in this case, crown 12. If slide 30 was connected to the lower unit, the lower unit could be referred to as the crown.

Leg members 24 are formed as an extension of bed 14 and are generally mounted on the shop floor 26 by means of shock absorbing pads 28. Tie rods 20 extend through crown 12, uprights 18 and bed portion 14, and are attached on one end with tie rod nut assemblies 22 of the present invention. On the other end of tie rods 20 are standard, non-expandable tie rod nuts 23.

Press shutheight is controlled by first measuring the shutheight between slide 30 and bolster 16 by a shutheight measuring means 32 such as a limit switch, an accelerometer or a non-contacting optical or electrical sensing means as is known in the art. A preferred non-connecting sensor is an eddy current transducer. Measurement of shutheight may also be achieved by measuring the pressure loads or vibrations through the press. Alternate methods of measuring shutheight may include monitoring press speed or the quality of workpieces produced by the press. The present invention is directed to improve and supplement current shutheight adjustment mechanisms thereby permitting shutheight adjustment while press 10 is cycling.

Figure 2:
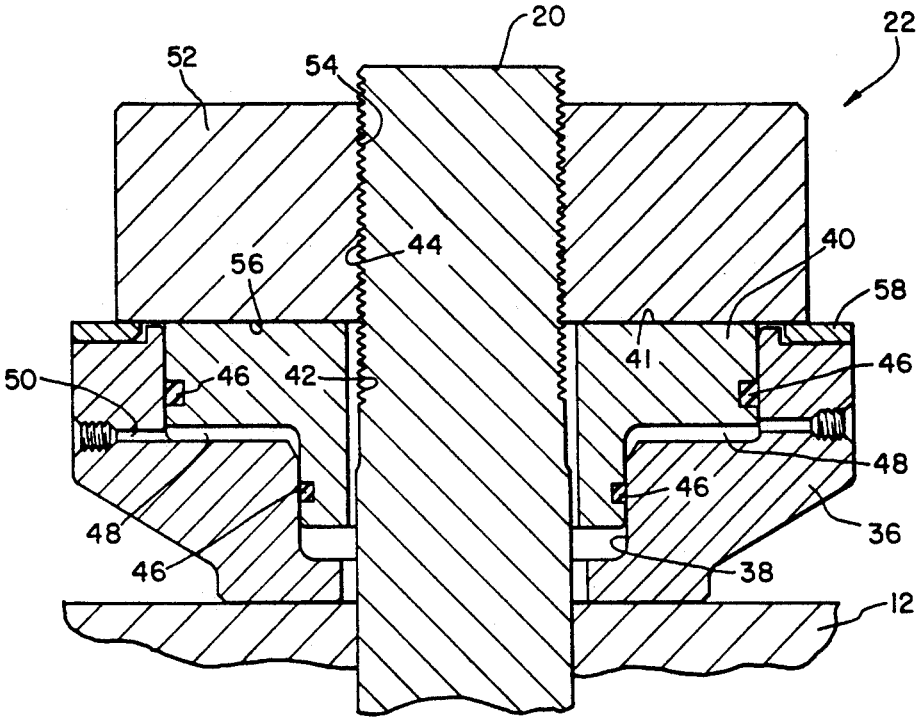
FIG. 2 is an enlarged sectional view of the hydraulic tie rod assembly of the present invention.
Figure 5:
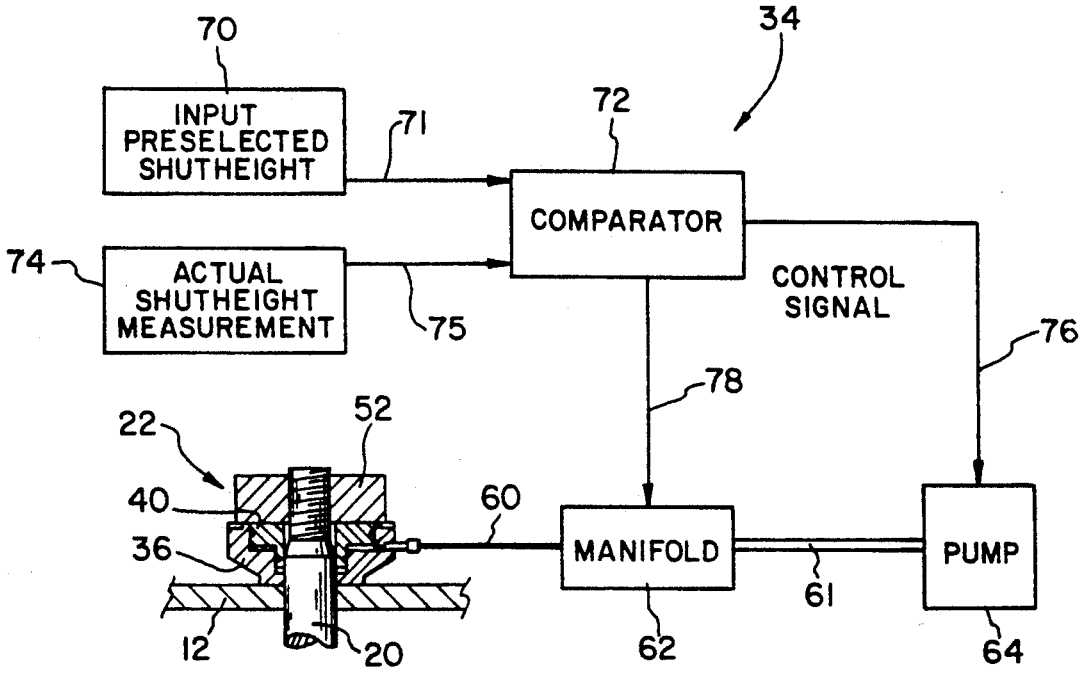
FIG. 5 is a schematic of the feedback means of the present invention.

The present invention comprises a hydraulic tie rod nut assembly 22 connected to a feedback system 34 which receives shutheight input from shutheight measuring means 32 (FIG. 5). Hydraulic tie rod nut assembly 22 comprises an annular cylinder 36 mounted upon crown 12 and about tie rod 20 (See FIG. 2). Cylinder 36 includes an annular bore 38 about tie rod 20 into which an annular piston 40 is slidingly interfit. Piston 40 includes an annular threaded bore 42 which is threadably engaged on threads 44 of tie rod 20. Piston 40 sealingly interfits within bore 38 by means of seals 46. Seals 46 seal between piston 40 and cylinder 36 defining a chamber 48. As shown in FIG. 2, chamber 48 is connected to an oil inlet 50 that is constructed through cylinder 36. Oil inlet 50 is in communication with an oil line 60 in fluid communication with oil purged by a pump 64 (FIG. 5). The present construction permits piston 40 to slide within cylinder 36 based on the pressure of oil injected through cylinder 50.

On piston 40 and tie rod 20 is threaded a tie rod nut 52 (FIG. 2). Nut 52 includes an annular bore having threads 54 that engage threads 44 of tie rod 20. The bottom surface 56 of tie rod nut 52 engages the top surface 41 of piston 40. A metallic preload spacer element 58 is interfit between cylinder 36 and tie rod nut 52 to maintain a selected preload. Spacer 58 is ground so as to be flat and interfit between cylinder 36 and nut 52 with barely any clearance. Spacer 58 will maintain the initial preload of the press in the event that oil pressure within chamber 48 is relieved. Spacer 58 thickness can be calculated on the basis of the theoretical stretching of the tie rod, compression of the crown, uprights and bed of press 10.

The feedback means for automatically controlling the shutheight will be discussed in relation to FIG. 5. However, it is understood and appreciated that alternative control arrangements may be utilized to control the shutheight and the required hydraulic pressure.

Automatic control of shutheight is maintained by a control feedback means 35 as shown in FIG. 5. Prior to operation, the press operator inputs a preselected shutheight through line 71 into a comparator 72. Feedback means 34 along with comparator 72 may comprise a microprocessor. Alternatively, comparator 72 may be constructed from a programmable logic controller as is known in the art. Comparator 72 receives input signals and provides output or control signals as a function of its inputs.

Shutheight measuring means 32 of FIG. 1 transmits an actual shutheight measurement 74 through line 75 to comparator 72 during press operation. Comparator 72 compares the difference between the preselected shutheight 70 and the actual shutheight 74 and forms a control signal on line 76 to an oil pressurizing means such as oil pump 64. Pump 64 may comprise of a typical air over oil pump to variably control the oil pressure within tie rod nut assemblies 22. Pump 64 connects to manifold 62 thereby pumping oil into and controlling pressurized oil therein. Manifold 62 communicates the pressurized oil by oil lines 60 to various hydraulic tie rod nut assemblies 22. The result of the comparison between the preselected shutheight 70 and the actual shutheight measurement 74 causes comparator 72 to vary the control signal on line 76 to pump 64 to vary oil pressure to the hydraulic tie rod nut assembly 22, thereby changing the compression between press bed 14 and press crown 12. Shutheight 25 is controlled by changing the oil pressure within chamber 48.

Alternatively, comparator 72, based on its inputs, may vary and send a control signal on a line 78 to manifold 62 to vary the pressure of oil pumped by pump 64. In this fashion, oil pressure within clearance space 48 may be controlled by a valve selectively opening and closing, such as an electric solenoid valve or throttle as is known in the art. The alternate valve may be integral to manifold 62. If necessary, comparator 72 may control more than one pump 64 and manifold 62.

If comparator 72 determines that the actual press shutheight 74 is too large, a control signal is sent through line 76 to cause pump 64 to increase pressure within chamber 48 thereby decreasing shutheight by compressing press crown 12 closer to press bed 14. When the measured shutheight 74 is too small, comparator 72 will signal pump 64 to reduce pressure within chamber 48.

At initial assembly, the press 10 will be preloaded at approximately full press tonnage. During this preload, oil is injected through oil inlet 50 into chamber 48. This oil is then pressurized to approximately 1200 PSI for a typical 100 ton press to approximate the full press tonnage. During the preload process, the pressure within chamber 48 will cause piston 40 to slide within bore 38 away from crown 12. As piston 40 slides away from crown 12 forcefully engaging and pressing into tie rod nut 52, a larger space will develop between cylinder 36 and tie rod nut 52. At the full preload pressure, the spacer element 58 of the preload separation between tie rod nut 52 and cylinder 36 is interfit therebetween. The insertion of spacers 58 are used to maintain the ga and preload stress between nut 52 and cylinder 36.

Figure 3:
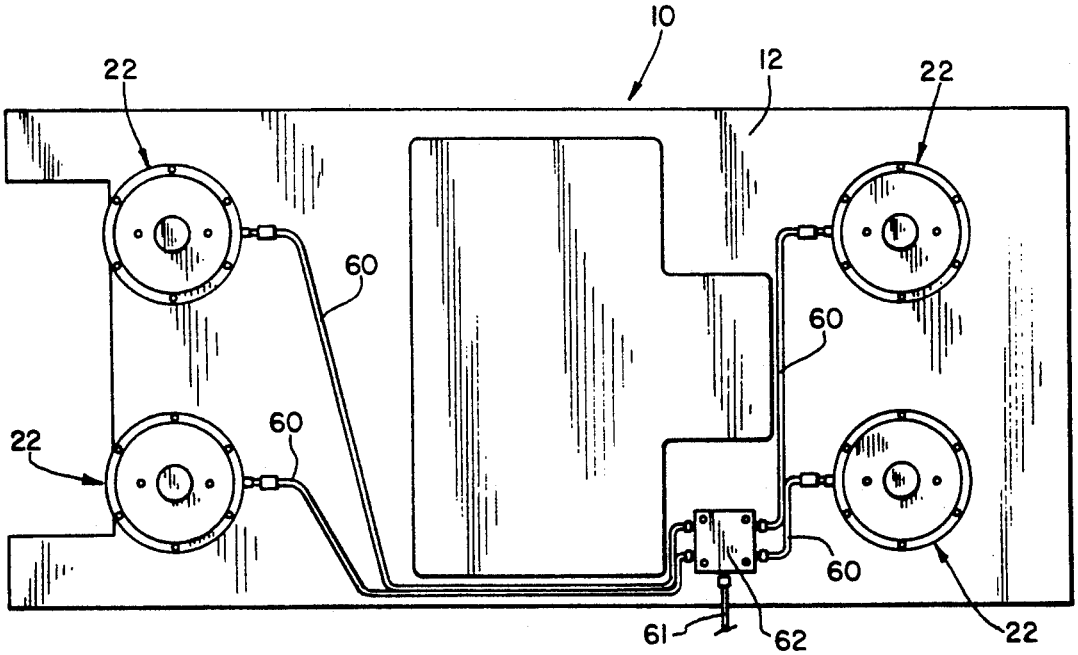
FIG. 3 is a top plan view of the press of FIG. 1 showing four hydraulic tie rod assemblies.

The tie rod nut assembly 22 is preferably attached to each of the tie rods in press 10. As shown in FIG. 3, four tie rod assemblies 22 are attached to the four tie rods 20 of press 10. FIG. 3 shows each tie rod nut assembly 22 connected by a high pressure oil hose 60 to a manifold 62.

In operation, press shutheight is controlled by first measuring the shutheight between slide 30 and bolster die 16 by a shutheight measuring means 32 such as a limit switch, or a non-contacting sensing means such as an eddy current transducer.

The present invention improves current shutheight adjustment mechanisms by permitting shutheight adjustment while press 10 is cycling. By comparing the measured shutheight value to a predetermined desired shutheight value, a decision is made whether to increase or decrease the shutheight of the press. Known means for creating this feedback system include programmable logic controllers and standard electronic computers that may be programmed to compare the two shutheight values and provide a signal to actuate a valve or pump (such as air over oil pump 64).

Upon the condition sensed by feedback means 34 that shutheight should be decreased, oil pressure within manifold 62 and therefore tie rod nut assemblies 22 is increased. From an approximate preload pressure of 1200 PSI for a typical 100 ton press, the feedback means 34 may vary the pressure from 1200 to 3500 PSI. This range of pressure changes should result in differences of approximately 0.010 inches in shutheight.

As shown in FIG. 1, a shutheight measuring means 32 is incorporated near slide 30. A pressurizing means, such as a pump 64 for pumping pressurized oil, is connected by means of an oil line 61 to manifold 62. Manifold 62 is connected by oil pressure lines 60 to the hydraulic tie rod nut assemblies 22. The feedback means 34 may be directly incorporated on the motor controller 4, motor 64 or on a separate unit.

The shutheight adjustment mechanism described may be installed easily to a press 10 without any changes in the press slide drive. Also, hydraulic tie rod nut assemblies 22 may be retrofitted to existing mechanical presses. By using a non-contacting shutheight measuring means, virtually no structural changes are needed to the press running gear. The feedback system described automatically changes the hydraulic pressure within hydraulic tie rod nuts 22 to vary the shutheight.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A press comprising:

a crown and a bed attached together by a frame; a slide attached to said crown for reciprocating movement in opposed relation to said bed;

a plurality of tie rods connecting between said crown and said bed;

a plurality of pressure activated tie rod nut assemblies attached to said tie rods so that when activated, said nut assemblies force said crown and said bed closer together;

a shutheight measuring means for measuring the shutheight of said press, said measuring means attached to said press; and feedback means connected to said shutheight measuring means and said tie rod nut assemblies for comparing a predetermined desired shutheight to the shutheight measured by said measuring means and pressure activating said tie rod nut assemblies when the measured shutheight deviates from the predetermined shutheight, whereby shutheight is controlled.

2. The press of claim 1 in which a tie rod nut assembly comprises:

a cylinder block having a cylinder bore fit about said tie rod;

a piston threadedly engaged about said tie rod and slidably disposed within said cylinder bore thereby forming an inner chamber, said inner chamber pressurized with a liquid; and a tie rod nut threadably engaged about said tie rod and engaging said piston.

3. The press of claim 2 in which said inner chamber is further defined by seals between said piston and said cylinder block.

4. The press of claim 2 in which said liquid comprises oil.

5. The press of claim 2 in which said tie rod nut assembly includes a spacer interfit between said nut and said cylinder block to maintain a desired preload on said press without said tie rod nut assemblies being pressurized.

6. The press of claim 2 having at least two said tie rod nuts assemblies in which said inner chambers of said tie rod nut assemblies are connected together by a manifold.

7. The press of claim 2 in which said feedback means controls the shutheight of the press by altering the pressure within said inner chamber.

8. The press of claim 1 in which said feedback means comprises:

a pump connected to said tie rod nut assemblies and activated by a control signal for changing the pressure of liquid communicated to said tie rod assemblies; and comparator means having input lines for a measured shutheight from said shutheight measuring means and a predetermined desired shutheight, said comparator means including a signal output line connected to said pump, said comparator means causing a control signal to be formed on said output line on the basis of a comparison between a measured shutheight and a predetermined desired shutheight.

9. A press comprising:

a crown and a bed attached together by a frame; a slide attached to said crown for reciprocating movement in opposed relation to said bed;

a plurality of tie rods connecting between said crown and said bed;

a plurality of pressure activated tie rod nut assemblies each including a cylinder block having a cylinder bore fit about said tie rod, a piston threadedly engaged about said tie rod and slidably disposed within s id cylinder bore thereby forming an inner chamber, said inner chamber pressurized with a liquid, and a tie rod nut threadably engaged about said tie rod and engaging said piston so that an increase in pressure within said inner chamber forces said tie rod nut away from said cylinder block;

a shutheight measuring means for measuring the shutheight of said press, said measuring means operatively associated with said press; and feedback means connected to said shutheight measuring means and to said tie rod nut assemblies for comparing a predetermined desired shutheight to the shutheight measured by said measuring means and altering the pressure within each said inner chamber when the measured shutheight deviates from the predetermined shutheight, whereby shutheight is controlled.

10. The press of claim 9 in which said feedback means includes a pump to pressurize said liquid, said pump controlled by said feedback means.

11. The press of claim 9 in which said feedback means includes a manifold connected to said inner chambers of said tie rod nut assemblies.

12. The press of claim 9 in which said feedback means controls the pressure within each tie rod nut assembly individually.

13. The press of claim 9 in which said liquid is pressurized to between 1200 p.s.i. and 3500 p.s.i.

14. The press of claim 9 in which said tie rod nut assembly includes a spacer interfit between said tie rod nut and said cylinder block to maintain a desired preload on said press without said tie rod nut assemblies being pressurized.

15. The press of claim 9 in which said inner chambers of said plurality of said tie rod nut assemblies are connected together by a manifold.

16. The press of claim 9 in which said feedback means comprises:

a pump connected to said inner chambers of said plurality of tie rod nut assemblies and activated by a control signal for changing the pressure of said liquid communicated to said inner chambers of said plurality of said tie rod assemblies; and comparator means having input lines for a measured shutheight from said shutheight measuring means and a predetermined desired shutheight, said comparator means including a signal output line connected to said pump, said comparator means causing a control signal to be formed on said output line on the basis of a comparison between a measured shutheight and a predetermined desired shutheight.

* * * * *